US005844457A

United States Patent [19]

Eckroth et al.

[11] Patent Number: 5,844,457

[45] Date of Patent: Dec. 1, 1998

[54] ELECTROMAGNETICALLY OPERATED ELECTRIC SWITCHING APPARATUS

[75] Inventors: Kurt V. Eckroth, Oconomowoc; David S. Hunter, Milwaukee, both of Wis.

[73] Assignee: Eaton Corporation, Cleveland, Ohio

[21] Appl. No.: 753,353

[22] Filed: Nov. 25, 1996

[51] Int. Cl.[6] ..... H01H 67/02

[52] U.S. Cl. ..... 335/132; 335/106; 335/128; 335/131; 335/133; 335/202; 200/241; 200/243

[58] Field of Search ..... 335/131–133, 335/128, 106, 202; 200/243, 241

[56] References Cited

U.S. PATENT DOCUMENTS

| | | | |
|---|---|---|---|
| 3,388,353 | 6/1968 | Isler | 335/132 |
| 4,009,457 | 2/1977 | Guery et al. | 335/132 |
| 4,404,442 | 9/1983 | Stich et al. . | |
| 4,528,535 | 7/1985 | Lemmer | 335/273 |
| 4,562,418 | 12/1985 | Bachler | 335/131 |
| 4,616,202 | 10/1986 | Kakizoe | 335/133 |
| 4,703,294 | 10/1987 | Yokoyama et al. | 335/121 |
| 4,922,216 | 5/1990 | Dietrich | 335/128 |
| 5,075,660 | 12/1991 | Ootsuka | 335/131 |

FOREIGN PATENT DOCUMENTS

| | | | |
|---|---|---|---|
| 744769 | 7/1980 | U.S.S.R. | 335/132 |

*Primary Examiner*—Lincoln Donovan
*Assistant Examiner*—Tuyen T. Nguyen
*Attorney, Agent, or Firm*—Larry G. Vande Zande

[57] ABSTRACT

A pair of pivoted links positioned at opposite sides of a movable armature and reversely oriented with respect to each other, have a pivotal connection at their opposite ends to a movable contact carrier and intermediate their ends to the armature whereby movement of the armature is amplified in movement of the contact carrier to permit reduction in the air gap between the armature and electromagnet core without incurring a corresponding reduction in contact carrier movement.

12 Claims, 7 Drawing Sheets

ELECTROMAGNETICALLY OPERATED ELECTRIC SWITCHING APPARATUS

BACKGROUND OF THE INVENTION

This invention relates to electromagnetically operated switching apparatus such as contactors and relays. More particularly, the invention relates to such switching apparatus having a drive means for the movable contacts which provides for a differential travel between the contacts and the electromagnet armature.

Electromagnetically operated switching contactors typically comprise a molded insulating housing which in turn comprises a molded base and a separable molded contact housing which serves as a cover for the base. An electromagnet comprising a magnetic core and an electrical coil are fixedly positioned in the base. Pairs of spaced stationary contacts are mounted in the contact housing. A movable contact carrier having a magnetic armature attached thereto is guided for reciprocal movement within the contact housing, the carrier having a plurality of movable contacts which move into and out of bridging engagement with the spaced pairs of stationary contacts. Springs are provided to bias the movable contact carrier and armature assembly away from the stationary magnetic core whereat the movable contacts are out of engagement with the stationary contacts. Energization of the electrical coil establishes a magnetic field in and around the stationary core and the movable armature, causing the armature to be attracted to the core which in turn moves the carrier and movable contacts into engagement with the stationary contacts.

Contactors are manufactured in several electrical and physical sizes to accommodate a wide range of loads. Accessory apparatus such as auxiliary switches, add-on contact blocks, magnetic latches, timers and the like are typically made attachable to the contactor housing and are operatively connected to the movable contact carrier and armature assembly through openings in the housing. Manufacturers of electrical contactors strive to achieve commonality in attachment means and movable contact carrier/armature stroke so a single accessory device may be commonly utilized with several sizes of electromagnetic contactors.

Electromagnetic contactors may be made to operate on either AC or DC. The DC operated contactor typically requires a physically larger coil with greater number of turns than does a comparable AC contactor. Commonly a DC coil comprises two separately wound coils, one being a pick-up coil and the other being a hold coil. In operation, the pick-up and hold coils are operated simultaneously upon initial energization of the contactor to effect armature movement to a sealed position with the core whereupon the pick-up coil may be de-energized and a smaller, less heat-producing hold coil remain energized to hold the contactor operated. This coil structure is typically physically larger than the AC coil for a comparable size contactor. When larger coils are required, other components and dimensions of the contactor are affected which may also affect the attachment and/or operation of auxiliary devices.

The need for a larger coil may be offset by reducing the gap between the armature and core of the electromagnet, thereby increasing the magnetic flux.

However, the contact carrier which operates the contactor contacts and the auxiliary devices, is directly connected to the armature. Accordingly, a reduction in travel of the armature results in a corresponding reduction in travel of the contact carrier.

SUMMARY OF THE INVENTION

It is therefore an object of this invention to provide electromagnetic switching apparatus such as an electromagnetic contactor or relay having a drive means for a movable contact carrier of the contactor which provides a differential travel between the contact carrier and armature.

It is a further object of this invention to provide electromagnetic switching apparatus such as an electromagnetic contactor or relay having a drive means for a movable contact carrier which provides a uniform predetermined travel for the contact carrier and permits predetermined variations in armature travel.

This invention provides an electromagnetically operated electric switching apparatus comprising an insulating housing having a stationary magnetic core and an electric coil positioned in a base of the housing and stationary contacts mounted in an upper cover portion of the housing, a contact carrier guided for reciprocal movement in the housing and carrying movable contacts for bridging the stationary contacts, a movable magnetic armature, and an amplification drive mechanism connecting the contact carrier and the armature for greater movement of the contact carrier relative to a lesser amount of movement of the armature. The invention, its features and advantages will become more readily apparent when reading the following description and claims in conjunction with the appended drawings.

DETAILED DESCRIPTION OF THE PREFERRED EMBODIMENTS

Figure 1:
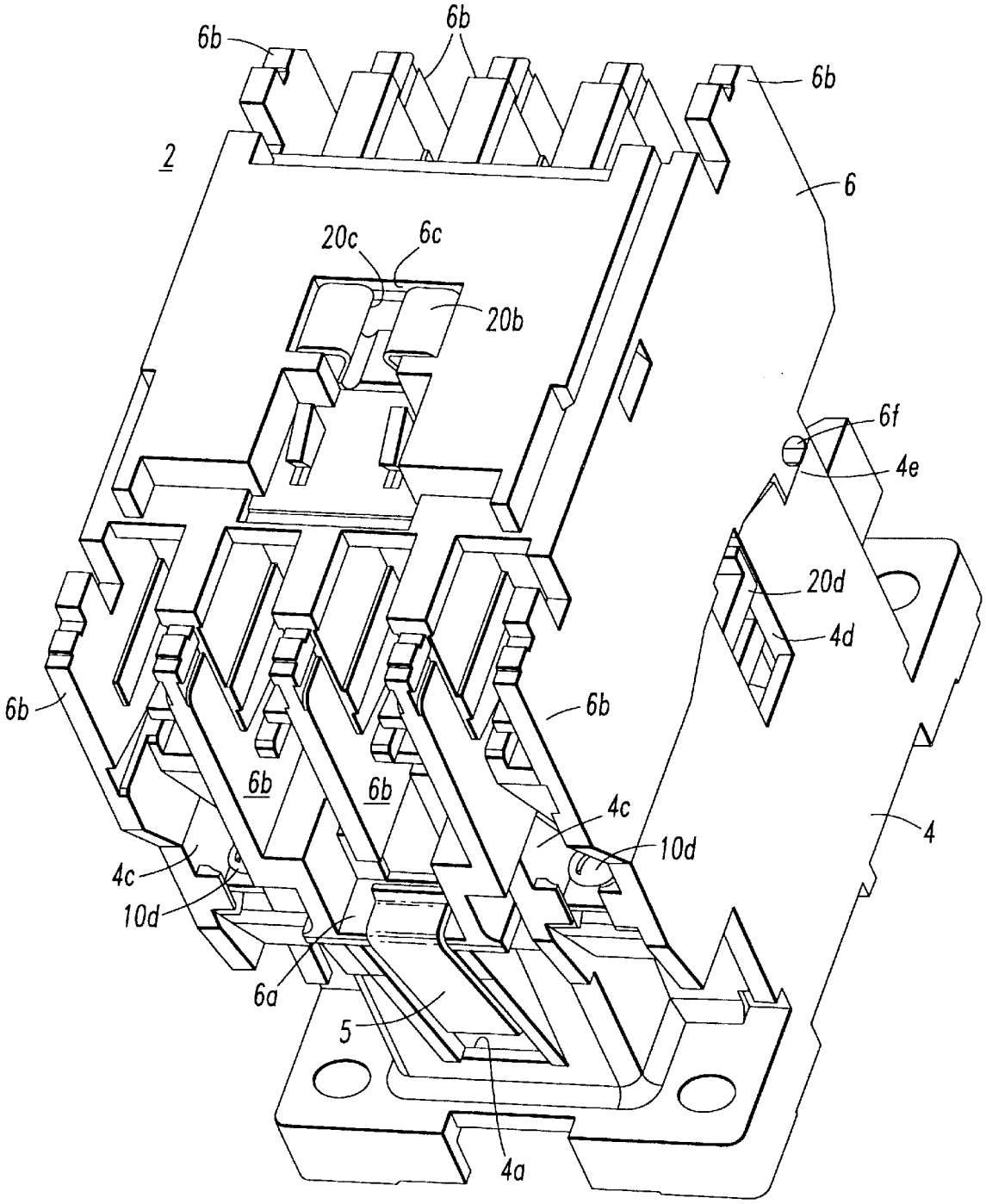
FIG. 1 is a three dimensional view of an electromagnetically operated contactor embodying this invention.
Figure 2:
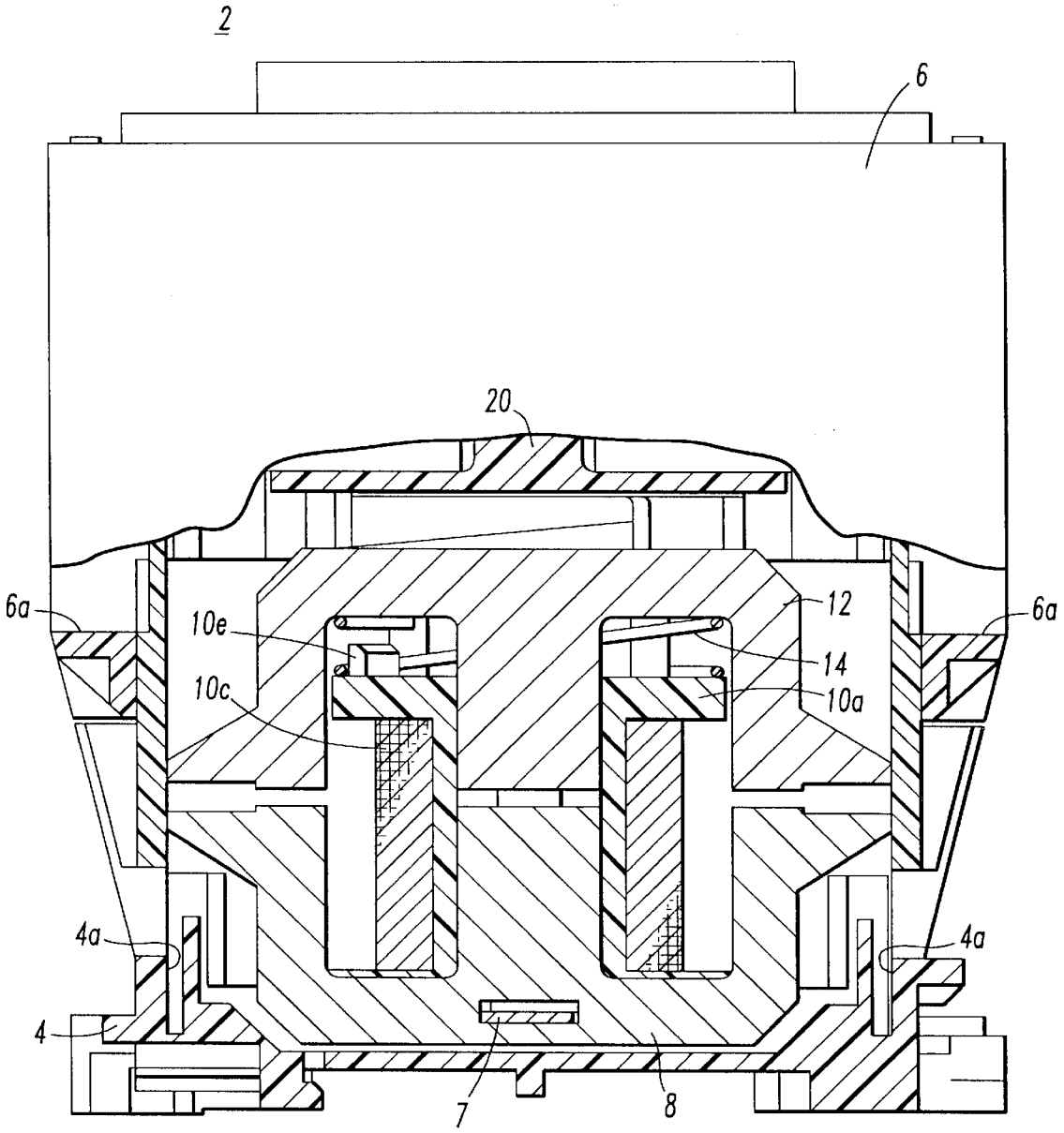
FIG. 2 is a partial cross sectional view of the contactor of FIG. 1 taken along line 2—2 in FIG. 5.
Figure 3:
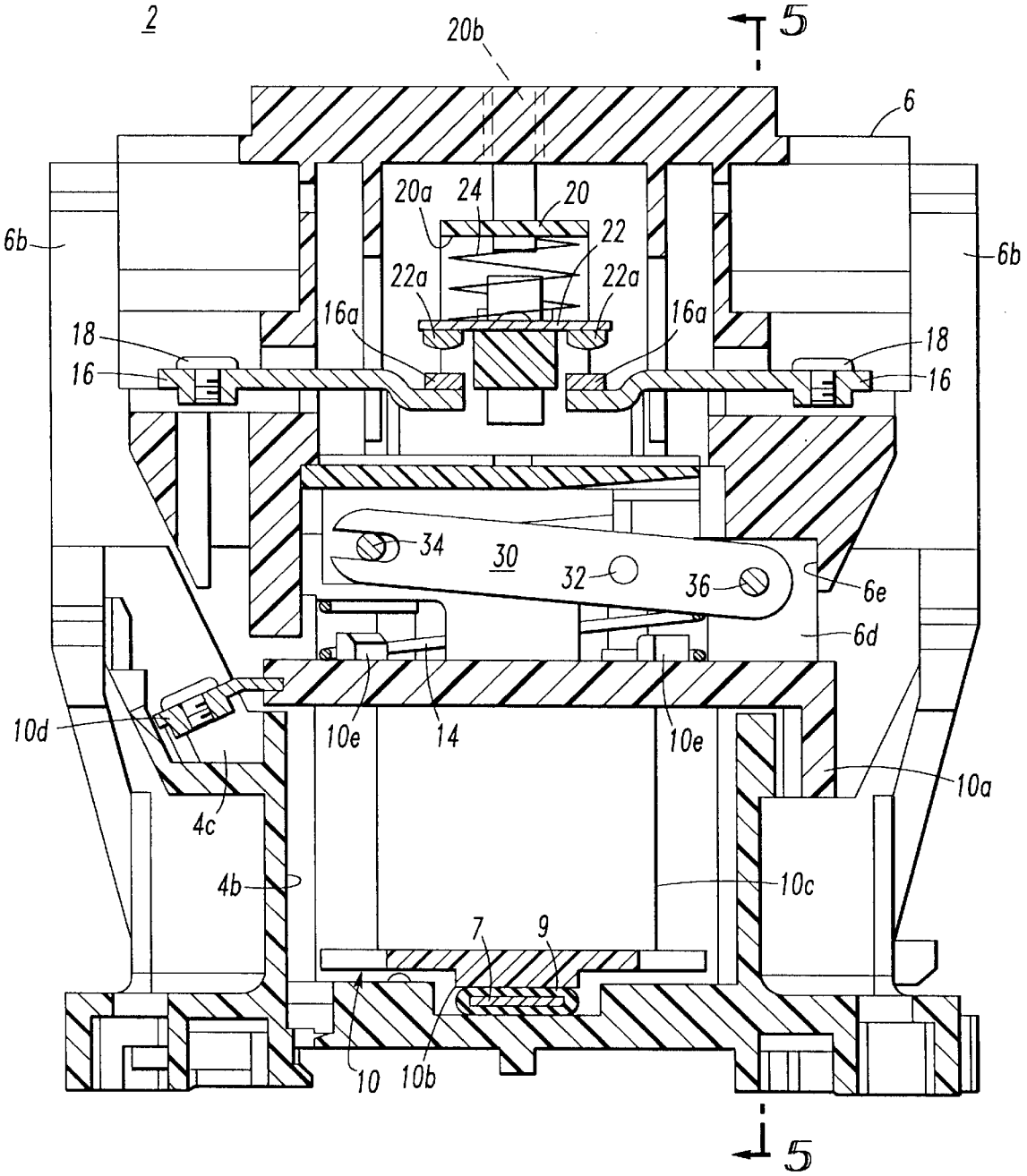
FIG. 3 is a cross sectional view of the contactor of FIG. 1 taken along the line 3—3 in FIG. 5.

Referring to the drawings and particularly to FIG. 1 an electromagnetically operated contactor 2 is shown in three dimensional view. Contactor 2 has a molded insulating housing comprising a molded base 4 and a molded contact housing 6 which is removably attached to the base by a pair of clips 5 (only one shown) which hook into openings 4*a* in the base and clip over surfaces 6*a* (only one shown) of contact housing 6. Base 4 has an upwardly open central cavity 4*b* which is covered by contact housing 6. An E-shaped magnetic core 8 is positioned in the bottom of central cavity 4*b* with the legs thereof extending upward. A retaining spring 7 (FIG. 2 and FIG. 3) is received in an opening in core 8 to extend outwardly of opposite sides of the core. Rubber bushings 9 (FIG. 3) are disposed over the opposite ends of spring 7. An electrical coil 10 is positioned within central cavity 4*b* over magnetic core 8. Coil 10 comprises a molded plastic bobbin 10*a* which overlies core 8 between the respective legs thereof Pads 10*b* (FIG. 3) on the bottom of plastic bobbin 10*a* bear upon rubber bushings 9 to compress the latter against base 4, thereby retaining core 8 in base 4 in the final assembly. A multiple turn wire coil 10*c* is wound on bobbin 10*a*. The ends of the coil wire are connected to wiring terminals 10*d* (FIGS. 1 and 3) which are molded into bobbin 10*a* and disposed within pockets 4*c* of base 4.

An E-shaped magnetic armature 12 is positioned over coil 10 with the respective legs extending downward in alignment with the corresponding legs of core 8. The center leg of armature 12 projects into a central hole in bobbin 10*a* and the outer legs thereof overlap the wound coil 10*c* and bobbin 10*a*. The distal ends of the legs of armature 12 are spaced from the corresponding ends of the legs of magnetic core 8 by a spring, for example a helical compression spring 14 disposed between bobbin 10*a* and armature 12. Upstanding projections 10*e* on the upper surface of bobbin 10*a* position spring 14 laterally on the coil, while the opposite end of the spring bears against the horizontal leg of the armature at the bases of the outer legs. Although the core 8 and armature 12 have been selected as mating E-shaped components, other electromagnet configurations may be used as well. It is further contemplated that other springs, e.g. a leaf spring, may be used to bias the armature away from the core. Contact housing 6 has a plurality of oppositely directed lateral barriers 6*b* which define switch poles of the contactor 2. Opposed pairs of stationary contacts 16 are retained in slots in the barriers 6*b* to extend into the housing 6. Contacts 16 have terminal screws 18 threadably connected in tapped holes at their outer ends for attachment of electrical conductors (not shown) to the contacts. High conductivity contact tips 16*a* are affixed to the inner ends of contacts 16.

A movable insulating contact carrier 20 is guided for vertical reciprocal movement within a hollow central area of contact housing 6. Movable contact carrier 20 has a plurality of openings 20*a* extending therethrough, the number of such openings corresponding to and aligned with the switch poles defined by the barriers 6*b*. Bridging contact bars 22 are disposed in the openings 20*a*, guided for limited vertical movement. The opposite ends of bridging contact bars 22 project beyond opposite sides of carrier 20 and have high conductivity contact tips 22*a* affixed thereto to be in alignment with respective tips 16*a* of stationary contacts 16. Helical compression springs 24 disposed in each opening 20*a* bear upon the respective bridging contact bar 22 to bias the bar against the bottom of the opening and to provide contact pressure for the contacts 16*a*–22*a* in the operated position of the contactor as will be described later. Movable contact carrier 20 has a central upstanding projection 20*b* that extends into an opening 6*c* (FIG. 1) in the top of contact housing 6. The distal end of projection 20*b* has a dovetail recess 20*c* for reception and coupling of an auxiliary or add-on switch block in a well known manner.

Typical contactor construction provides for the armature 12 and movable contact carrier 20 to be rigidly connected together. Energization of electrical coil 10 creates a magnetic field in core 8 and armature 12 which attracts armature 12 to the core, against the bias of spring 14. This movement of armature 12 drives movable contact carrier 20 downward, causing bridging contact tips 22*a* to engage stationary contact tips 16*a*, compressing springs 24 slightly. Spring 14 drives the armature, contact carrier and movable contacts back to their original position upon deenergization of the coil. The travel distance of the carrier and movable contacts is selected at a necessary amount to provide effective arc extinction and dielectric withstand within the housing. The distal end of projection 20*b* also moves downward with respect to the top of contact housing 6, as do side actuator pads 20*d* of contact carrier 20 disposed within side openings 4*d* (FIG. 1, only one visible) in base 4. Thus the amount of movement of contact carrier 20 and its auxiliary device actuators 20*c* and 20*d* is identical to the amount of movement of armature 12 to a sealing position against stationary core 8. Contactor manufacturers offer such auxiliary devices to attach to the contactor housing and which are operated by the various actuators 20*c* and 20*d* upon movement thereof the predetermined amount set by the armature and the core.

If the travel distance of the armature to the core is changed for any reason, circuit interruption by the contacts and operation of all of the auxiliary devices will be affected. For example, a comparably sized DC contactor magnet generates less magnetic force than an AC magnet. This may be overcome by increasing the size of the coil or by providing a dual winding coil having pick-up and hold windings. Such changes have a dimensional impact upon the armature travel distance. Another means of increasing the magnetic force is to increase the area of the pole faces of the magnet or to reduce the gap between the armature and core. Gap reduction takes advantage of the exponential increase in force achieved for each increment of reduction, but also provides less armature travel.

This invention provides for relative movement between the armature 12 and the movable contact carrier 20. This is accomplished by an amplification drive mechanism connecting the armature to the contact carrier. The amplification drive mechanism comprises a pair of elongated links 30 pivotally mounted in the insulating housing of the contactor 2, the links having connection with the armature and with the contact carrier at different distances along the link from the pivot of the link. Thus, the links effect greater movement of the contact carrier 20 than the armature 12.

As seen in the drawings, links 30 are preferably elongated flat members although variations in the links are contemplated within the scope of this invention.

Each link 30 has a hole 30*a* at one end, an open slot 30*b* at an opposite end, and a second hole 30*c* intermediate the ends and located nearer hole 30*a*. Links 30 are disposed on opposite sides of armature 12 and are reversely oriented end-for-end relative to each other. Armature 12 has blind holes 12*a* formed in opposite sides of the common leg, offset from center. Pins 32 are pressed into holes 12*a* such that a major portion of their length projects from the respective sides of armature 12. Links 30 are assembled to pins 32 by aligning holes 30*c* with pins 32 and sliding the links onto the pins, whereby the link may rotate freely on the pin.

Figure 4:
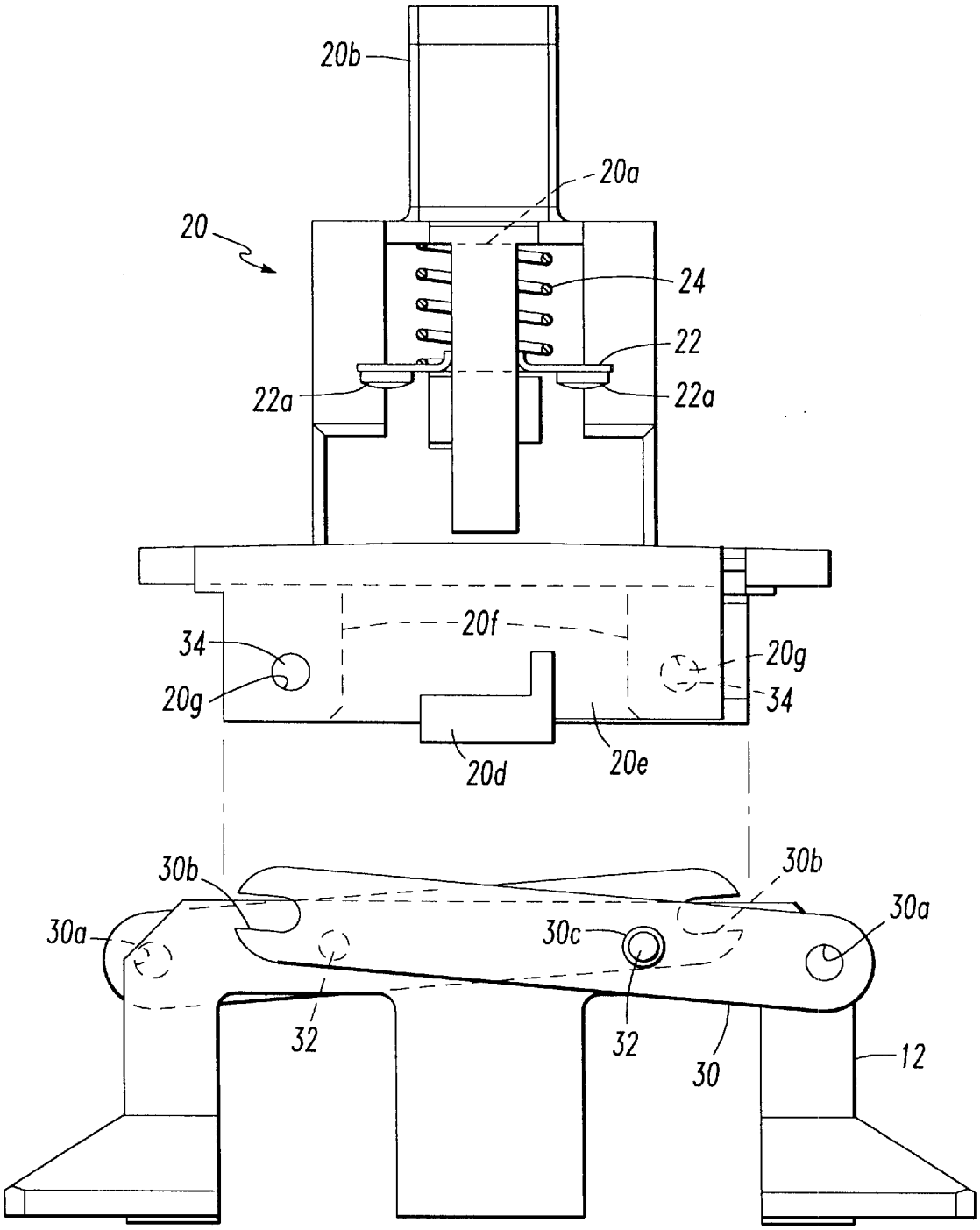
FIG. 4 is an exploded side elevation view of the movable contact carrier assembly, armature and amplification mechanism of this invention.
Figure 6:
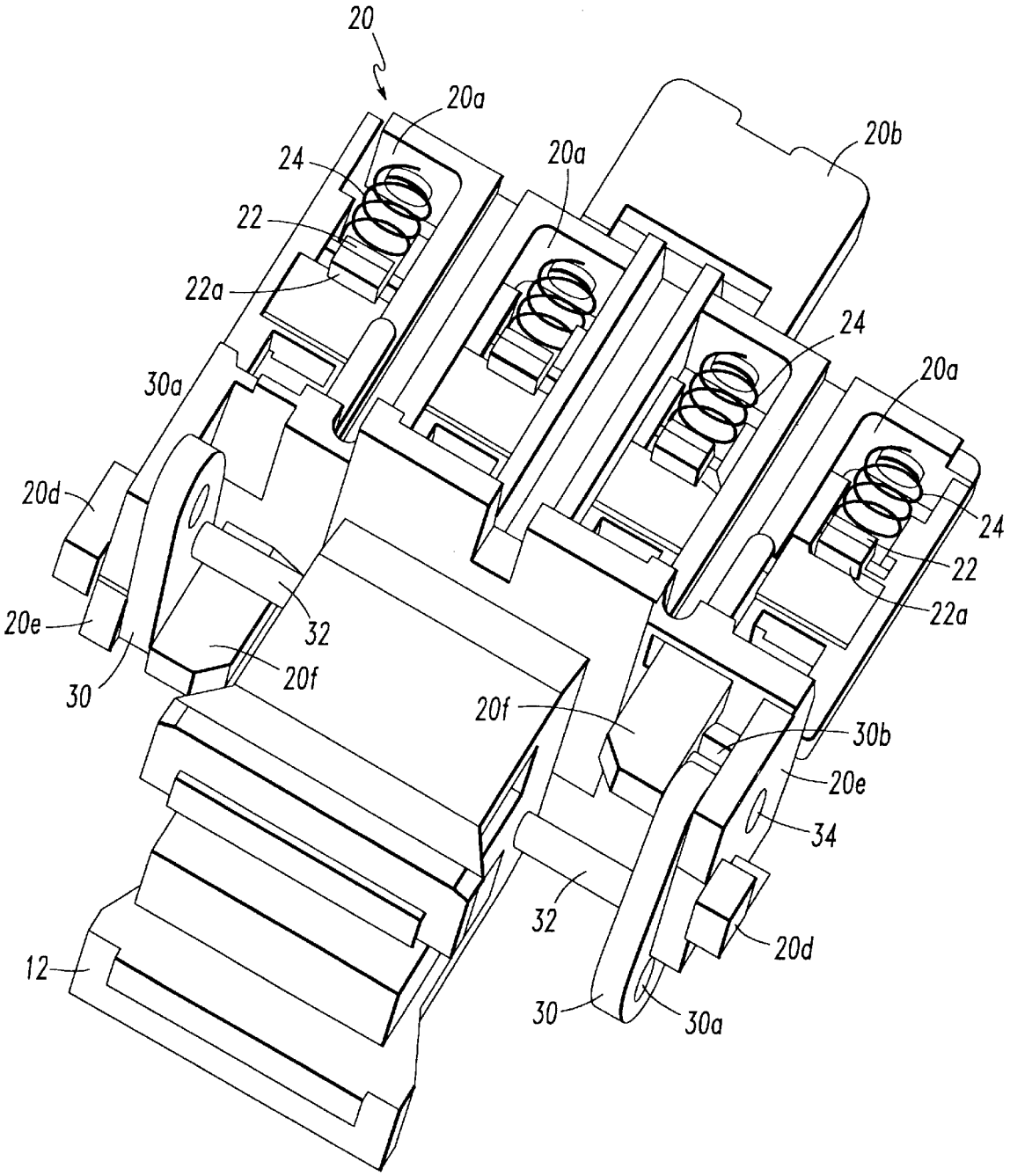
FIG. 6 is a three dimensional view of the movable contact carrier assembly, armature and amplification drive mechanism of this invention view from the underside and rotated to a nearly horizontal position.
Figure 7:
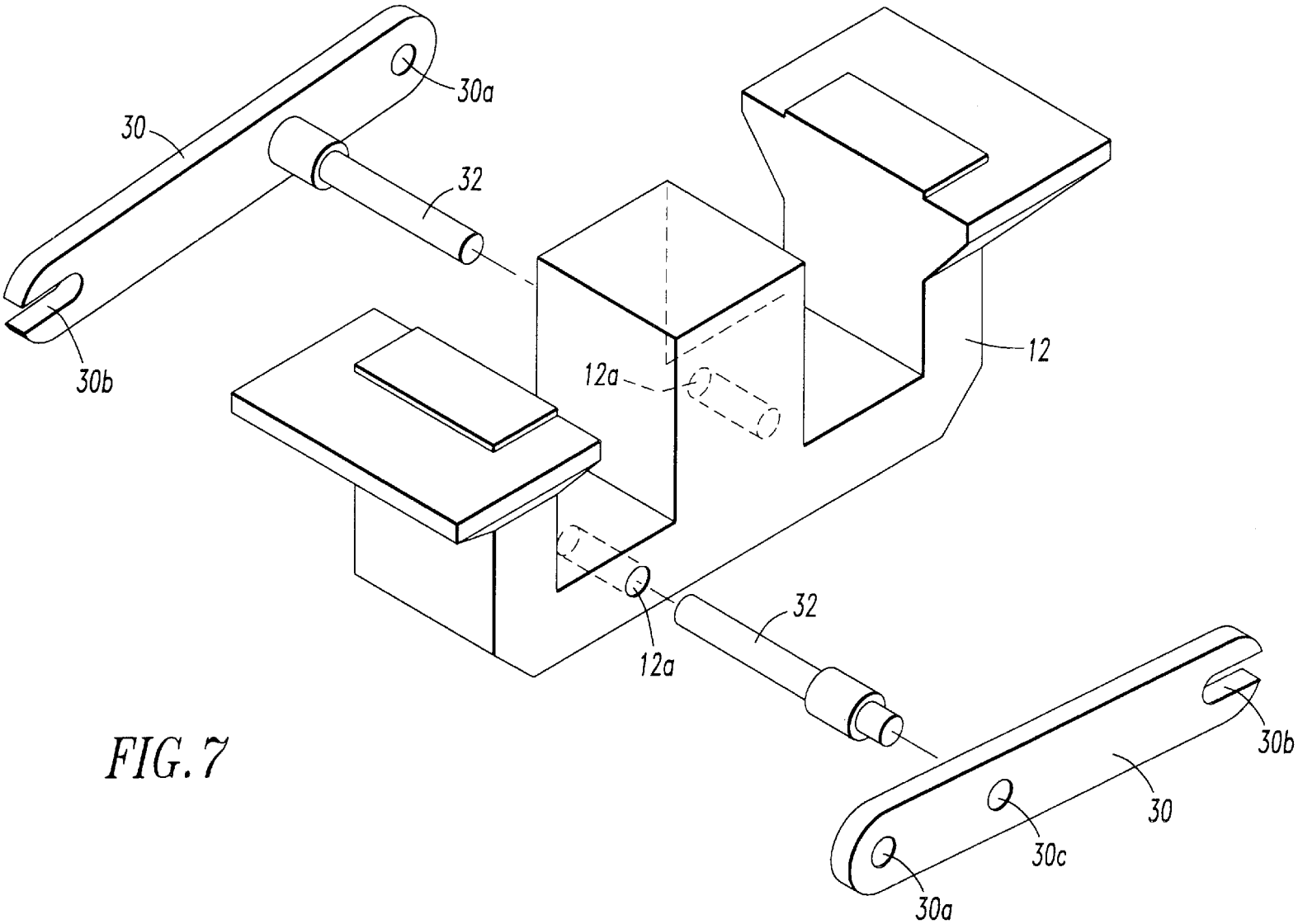
FIG. 7 is an exploded three dimensional view of the armature and amplification drive mechanism of this invention.

The armature 12 and links 30 are attached to the underside of contact carrier 20 as particularly shown in FIG. 6. The ends of contact carrier 20 comprise depending walls 20*e* on which actuator pads 20*d* are formed. A depending finger 20*f* is spaced inwardly from and parallel to the inside surface of each respective end wall 20*e* at opposite fore and aft edges of the respective walls. A hole 20*g* (FIG. 4) is provided through each end wall 20*e* and extends partially into the respective finger 20*f* to receive a pin 34 therein which spans the space between the respective end wall 20*e* and finger 20*f*. The armature 12 and rotatably attached links 30 are attached to contact carrier 20 by inserting the open slots 30*b* of links 30 over the pins 34 within slots defined by the spaces between end walls 20*e* and fingers 20*f* and pushing armature 12 toward the underside of contact carrier 20 to rotate links 30 to a nearly horizontal position whereby the slots 30*b* fully surround the pins 34.

Figure 5:
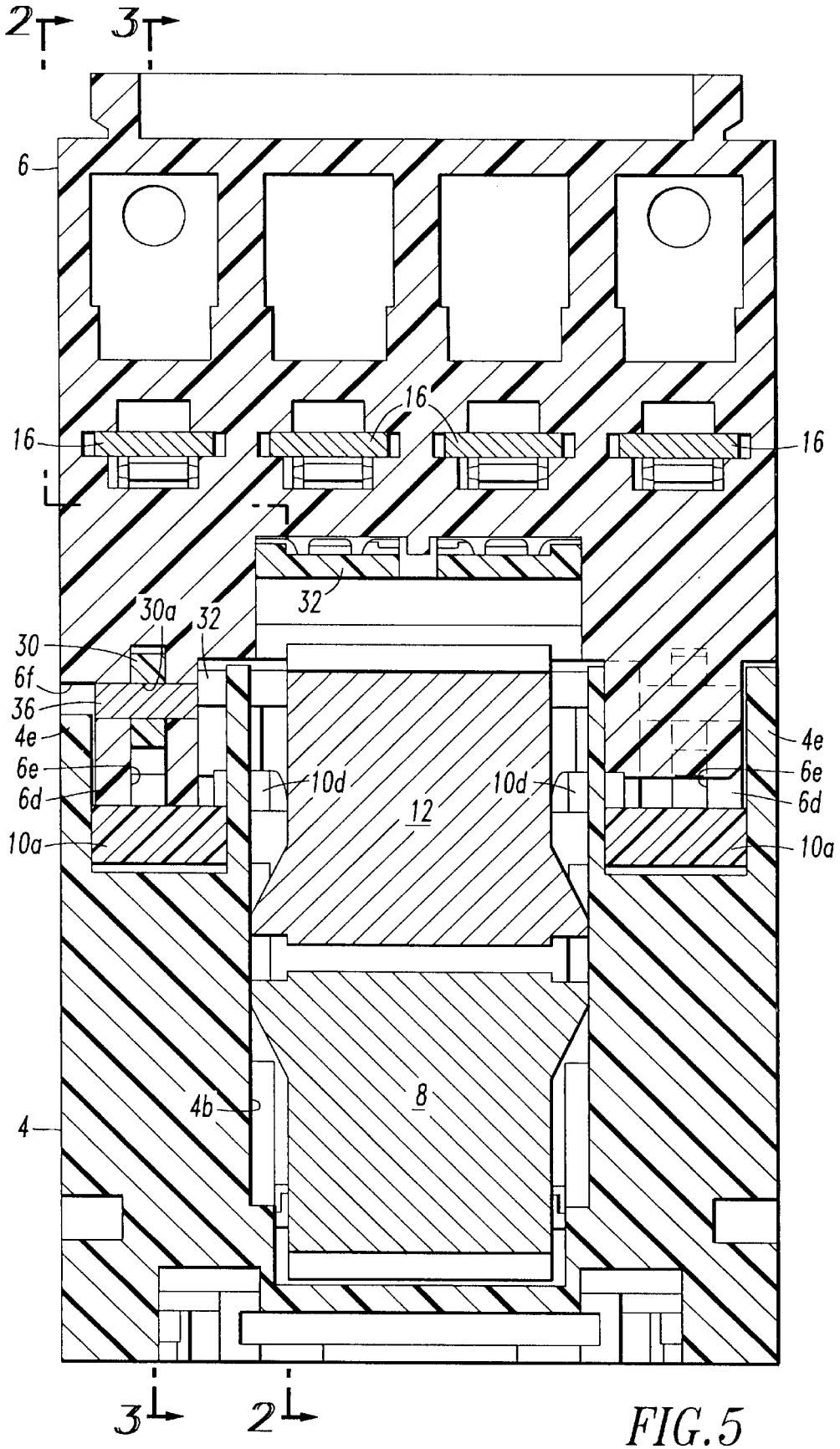
FIG. 5 is a cross sectional view taken along the line 5—5 in FIG. 3 showing one link of the amplification drive mechanism connected to the contactor housing.

The armature 12, contact carrier 20 and links 30 are next assembled to the contact housing 6. Referring to FIG. 5, it can be seen that contact housing 6 and base 4 have an overlapping construction along their juncture wherein upstanding walls such as 4*e* of base 4 overlap depending portions such as 6*d* of contact housing 6. Slots 6*e* are provided in depending positions 6*d* of contact housing 6 for receipt of the links 30. Holes 6*f* are provided through depending portions 6*d* from the exterior surface of contact housing 6. The ends of links 30 containing holes 30*a* are positioned in slots 6*e* such that holes 6*f* and 30*a* align, and pins 36 are pressed into holes 6*f* to form pivot axles for links 30, and to retain the armature 12, contact carrier 20 and links 30 assembled to contact housing 6.

With the contact housing 6 assembled to base 4 and electric power connected to the coil terminals 10*d*, the contactor 2 is ready to close and open circuits comprising the stationary contacts 16 of respective poles of the contactor. When energized, coil 10 sets up a magnetic field in the iron core 8 and armature 12, attracting the armature to the core. This movement of armature 12 rotates the links 30 downward about the respective pivot pin 36 through the connection of pins 32. The movement of links 30 carry pins 34, and therefore contact carrier 20, downward, closing movable contact tips 22*a* upon stationary contact tips 16*a* to complete a circuit between opposed stationary contacts 16. As can be seen in the drawings, pins 32 are much nearer pins 36 than are pins 34 within the slotted ends of links 30. Accordingly, the downward movement of contact carrier 20 is amplified over the downward stroke of armature 12, which may be originally spaced a smaller distance from core 8 to reduce the gap therebetween and increase the magnetic force. The amount of amplified movement of contact carrier 20 relative to movement of armature 12 can be varied by moving the pivotal connection to the armature at pin 32 nearer or farther from the fixed pivot at pin 36. It has also been observed that contact bounce is reduced by the amplification linkage because the armature, traveling a shorter distance, does not achieve the final velocity of the longer stroke. Thus, the speed of contact closure is reduced, as is the contact bounce.

It will be appreciated from the foregoing that the invention provides an electromagnetic contactor wherein the armature and contact carrier are made movable relative to each other and that the distance traveled by one of these members may be greater or less than the distance traveled by the other of these members in an operation of the contactor. The invention has particular advantage where auxiliary switching devices are operated from movement of the contact carrier. Although a single preferred embodiment has been disclosed, it should be readily apparent to one skilled in the art that the invention is susceptible of various modifications without departing from the scope of the appended claims.

We claim:

1. Electromagnetically operated electric switching apparatus comprising:

an insulating housing;

an electromagnet mounted in said housing;

stationary contacts mounted in said housing in spaced apart relation;

a movable contact carrier guided for reciprocal movement in said housing;

movable contacts mounted on said contact carrier for movement therewith into and out of bridging engagement with said stationary contacts;

a magnetic armature movable toward said electromagnet upon energization of said electromagnet; and an amplification drive mechanism connecting said contact carrier and said armature, said amplification drive mechanism comprising a pair of links respectively disposed on opposite sides of said armature, said links each having pivotal connection at one end thereof to said housing and at opposite ends thereof to said contact carrier, and having pivotal connection to said armature intermediate said one end and said opposite end, said amplification drive mechanism effecting greater movement of said contact carrier than said armature as said armature moves toward said electromagnet.

2. The electromagnetically operated electric switching apparatus defined in claim 1 wherein at least one of said pivotal connections for each said link permits translational movement of said one connection at right angles to movement of said armature and said contact carrier.

3. The electromagnetically operated electric switching apparatus defined in claim 2 wherein said links each comprise an elongated aperture at said opposite ends, and said contact carrier comprises a pin received in said elongated aperture.

4. The electromagnetically operated electric switching apparatus defined in claim 1 wherein said links are reversely oriented relative to each other, said respective one end of each said link being disposed at opposite ends of said armature.

5. The electromagnetically operated electric switching apparatus defined in claim 1 wherein said pivotal connection to said armature is located on said links at a predetermined distance from said pivotal connection to said housing to provide a predetermined movement of said contact carrier.

6. The electromagnetically operated electric switching apparatus defined in claim 1 wherein said housing and said contact carrier comprise slots at said pivotal connections for receiving said links, said slots maintaining said links spaced away from said sides of said armature a predetermined distance and for maintaining alignment of said armature relative to said electromagnet.

7. In an electromagnetic contactor having:

spaced stationary contacts;

a movable contact carrier;

movable contacts carried by said contact carrier and movable therewith into and out of bridging engagement with said stationary contacts;

an electromagnet comprising a fixed core, a coil, and an armature movable into and out of engagement with said core;

the improvement comprising an amplification drive system connecting said movable contact carrier to said armature, said drive system being driven by said armature for amplifying movement of said carrier relative to movement of said armature.

8. The electromagnetic contactor defined in claim 7 wherein said amplification drive system comprises:

a fixed pivotal mount;

an elongated member pivotally mounted to said mount at one end of said member and pivotally connected at an opposite end thereof to said movable contact carrier; and coupling means for coupling said armature to said member between said fixed pivotal mount and a midpoint of said member.

9. The electromagnetic contactor defined in claim 8 wherein said pivotally connected opposite end of said elongated member to said movable contact carrier comprises a translational pivotal connection.

10. The electromagnetic contactor defined in claim 7 wherein said amplification drive system comprises:

a pair of fixed pivotal mounts;

a pair of elongated members disposed along opposite sides of said armature, said members being pivotally mounted at respective first ends thereof to respective said fixed pivotal mounts, said members having translational pivotal connections with said movable contact carrier at respective second ends of said members; and coupling means for coupling said armature to said members at locations on said members between said first end and a midpoint of respective said members.

11. The electromagnetic contactor defined in claim 10 wherein said fixed pivotal mounts are respectively disposed at opposite ends of said armature, and said members pivotally mounted to said mounts pivot in opposite direction.

12. The electromagnetic contactor defined in claim 11 wherein said translational pivoted connections are made at respective opposite ends of said movable contact carrier.

* * * * *